United States Patent [19]

Kano

[11] 4,096,725

[45] Jun. 27, 1978

[54] STRIPPER GUIDES FOR ROLLING MILL

[75] Inventor: Yasunao Kano, Kashima, Japan

[73] Assignee: Sumitomo Metal Industries, Ltd., Osaka, Japan

[21] Appl. No.: 847,618

[22] Filed: Nov. 1, 1977

Related U.S. Application Data

[63] Continuation-in-part of Ser. No. 692,022, Jun. 1, 1976, abandoned.

[51] Int. Cl.[2] ..... B21B 39/00

[52] U.S. Cl. ..... 72/250; 72/161

[58] Field of Search ..... 72/251, 250, 227, 428, 72/161

[56] References Cited

U.S. PATENT DOCUMENTS

| | | | |
|---|---|---|---|
| 3,258,953 | 7/1966 | Hermes et al. | 72/250 |
| 3,513,680 | 5/1970 | Modder | 72/250 |

FOREIGN PATENT DOCUMENTS

| | | | |
|---|---|---|---|
| 945,682 | 7/1956 | Germany | 72/250 |

*Primary Examiner*—Milton S. Mehr

[57] ABSTRACT

Stripper guides are disposed adjacent to upper and lower work rolls at the exit side of the rolling mill. In each of the stripper guides is rotatably provided a roll for straightening the turned up or turned down portion at the leading end of the strip.

3 Claims, 5 Drawing Figures

STRIPPER GUIDES FOR ROLLING MILL

This application is a continuation-in-part of application Ser. No. 692,022, filed June 1, 1976, now abandoned.

The present invention relates to an improvement in stripper guides disposed adjacent work rolls in plate mills, particularly mills for rolling hot slab into a plate or strip.

In these rolling mills, the stripper guides are disposed above and below the pass line adjacent to the exit side of the work rolls and serve to guide rolled material along the pass line. Generally, the stripper guides themselves do not function to straighten any bend in rolled material. The material fed into the roll gap is delivered from the gap sometimes with an upward or downward bend, that is to say a turned up or turned down portion caused either by a slight shift of the feeding direction upward or downward or by a bend produced in the material itself during rolling. And an extreme bend sometimes leads to accidents such as jamming.

The conventional stripper guides of the plate or strip mill serve merely to guide the rolled material along the pass line and do not function to bend the turned up or turned down leading end of the rolled material back toward the pass line. It has been very difficult to straighten the turned up or turned down end of the strip in the limited narrow space.

Moreover, because the plate or strip mill is handling relatively wide materials, the stripper guides are subjected to strong impact forces when the turned up or turned down ends of the strip strike them. They cannot bend such ends back toward the pass line.

Accordingly, an object of the present invention is to provide stripper guides capable of bending the upward or downward bend of the leading end of the rolled material delivered from the roll gap during the rolling operation so that it is straighter than it would be without such bending, and in practice is substantially straight, thereby preventing the jamming caused by the bent end.

SUMMARY OF THE INVENTION

The present invention is characterized in that known stripper guides disposed adjacent to the work rolls of a rolling mill are provided with a pair of rolls which are disposed respectively above and below the pass line and which are rotatable respectively with a portion of the periphery thereof projecting slightly from the guide surface of the respective stripper guides, which rolls act to bend the turned up or turned down ends of the strip back toward the pass line to at least partially straighten these bent ends.

BRIEF DESCRIPTION OF THE DRAWINGS

The invention will be better understood from the following description taken in connection with the following drawings in which.

DESCRIPTION OF THE PREFERRED EMBODIMENTS

Certain preferred embodiments of the present invention will now be described with reference to the drawings.

Figure 1A:
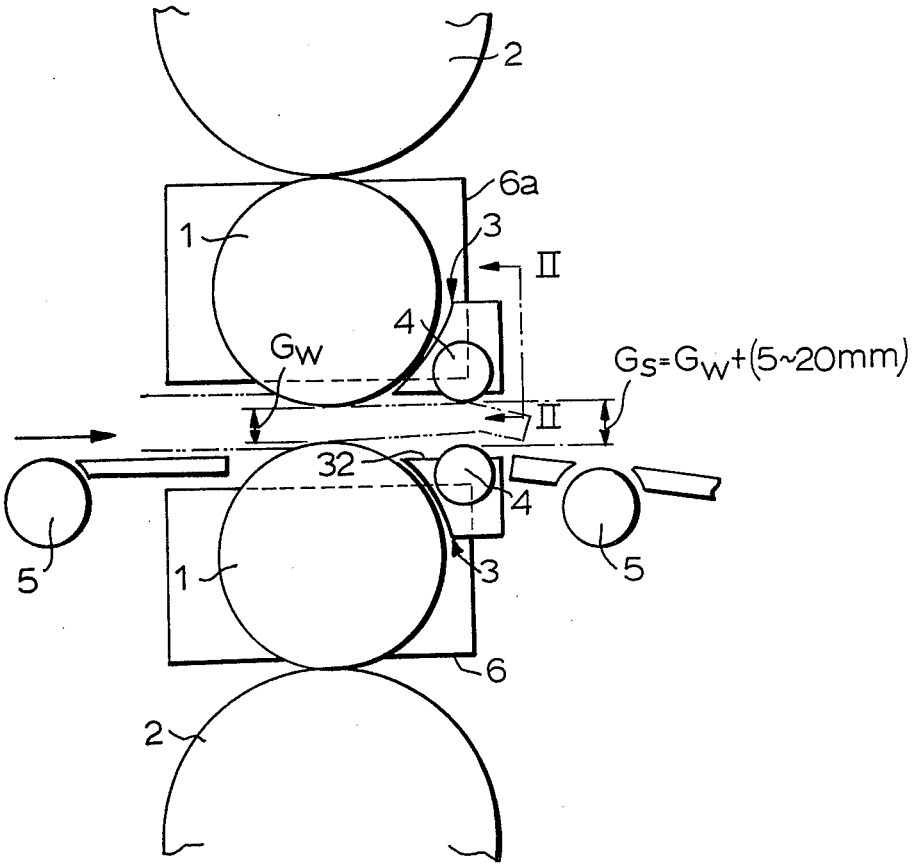
FIGS. 1A and 1B are schematic side elevation views showing constructions of the stripper guides according to the invention mounted in a known rolling mill.

In FIG. 1A, numeral 1 denotes work rolls backed by back-up rolls 2 and having stripper guides 3 on the output side thereof with rolls 4 rotatably supported by the stripper guides. Each of said rolls 4 is disposed with a portion of its periphery slightly projecting from a guide surface 32 of the stripper guide (See FIG. 3). Numeral 5 denotes table rollers.

Figure 1B:
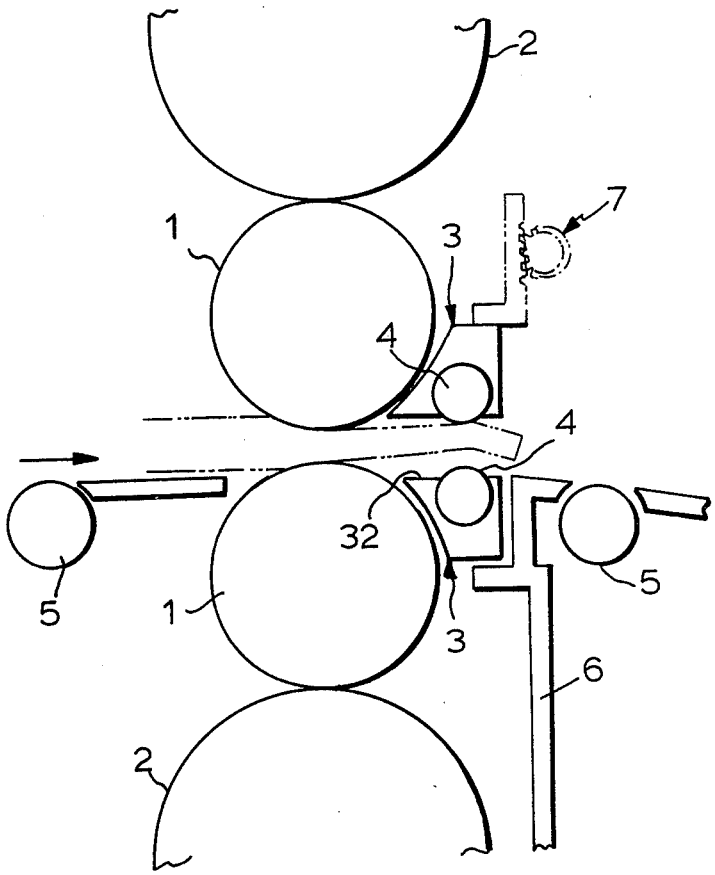

The stripper guides 3 are disposed adjacent to the exit side of the work rolls and opposed to each other above and below the pass line of the rolled material. Generally, the lower stripper guide 3 is mounted stationarily in lower work roll chocks 6a, in a housing or guide support for the rolling mill. The upper stripper guide 3 is fixed normally in work roll chocks 6b. In another embodiment shown in FIG. 1B the upper stripper guide 3 is fulcrumed at a support fixed to the housing and the like of the rolling mill and is vertically adjustable according to the work roll gap by a suitable elevator means 7 such as a hydraulic cylinder or electric motor fixed to the housing. It is preferable that the rolls 4 are adjustable so that the shafts thereof are movable relative to the stripper guides within certain limits. The gap $G_s$ between the rolls 4 is preferably set to be equal to the gap $G_w$ between the work rolls plus 5 to 20 mm.

Figure 2:
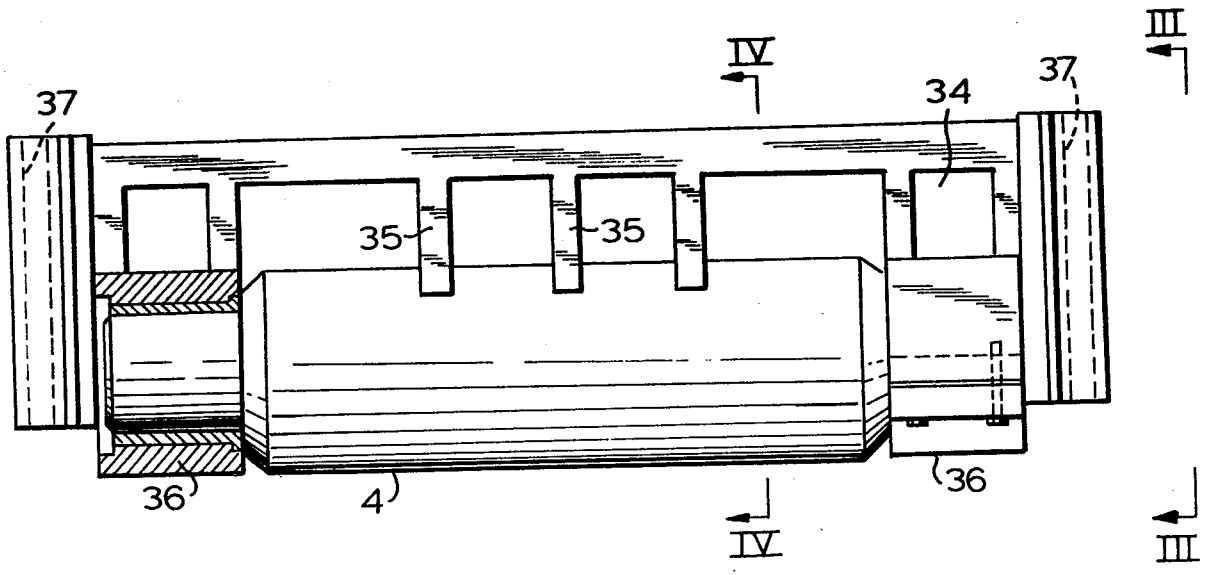
FIG. 2 is an enlarged front view of the stripper guide taken along the line II—II of FIG. 1A.
Figure 3:
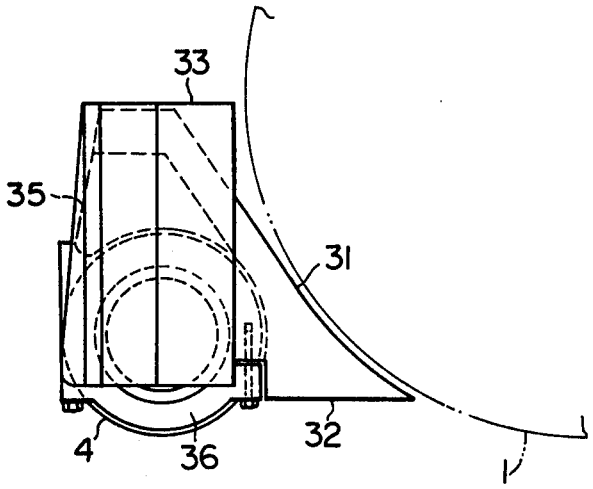
FIG. 3 is a side view taken along the line III—III of FIG. 2.
Figure 4:
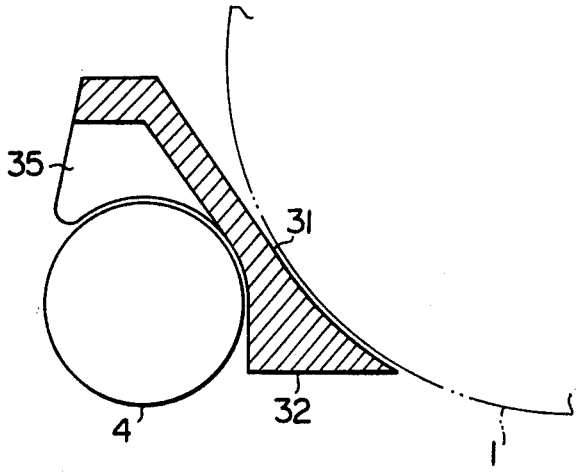
FIG. 4 is a side sectional view taken along the line IV—IV of FIG. 2.

FIGS. 2 to 4 illustrate in detail an example of the upper stripper guide 3 schematically shown in FIG. 1A. The construction of the stripper guide can of course be modified in design or replaced within the scope of this invention.

In this embodiment, the stripper guide body is cast from cast steel and has a curved surface 31 so that it can be positioned close to the outer periphery of the work roll 1, a guide surface 32 receding substantially horizontally from the end of said curved surface and forming an acute angle therewith, a top surface 33 receding substantially horizontally from the rear end of said curved surface, boxes 34 provided at opposite lateral ends of the body for receiving bearings of the rolls 4 leaving a space behind said curved and guide surfaces, and a plurality of reinforcing ribs 35 projecting from the body between said two boxes and spaced suitably from each other.

Bearings 36 are split bearings. For assebly of the bearings, one half of each bearing is first fixed by means of bolts to said boxes 34, then the journals of the roll 4 are received in the thus mounted bearing halves and the other halves of the respective bearings are fastened to the fixed halves by means of bolts to support the roll rotatably in the bearings. It is necessary to design it so that a portion of the periphery of the barrel of the roll 4 slightly projects from the guide surface 32 as shown in FIGS. 3 and 4. The top surface 33 is provided with holes 37 therethrough for receiving bolts to secure the stripper guide to the support.

The stripper guides according to the present invention are disposed in the same relative positions as the heretofore known stripper guides. Therefore, the known stripper guides can be easily remodeled into the stripper guides according to the present invention simply by adding the rolls to them and mounting them on the supports without the necessity to remodel the work roll chock or the rolling mill itself.

The embodiment shown in FIGS. 2 to 4 is an example in which the upper stripper guide 3 shown in FIG. 1A is fixed to a work roll chock *6a*. While an embodiment in which the upper stripper guide 3 shown in FIG. 1B can have the vertical position thereof adjusted independently of the work roll 1 by means of the elevator means 7 fixed to the housing is not particularly shown, it will be obvious to the skilled in the art that this embodiment is substantially similar to that described with reference to FIGS. 2 to 4.

By the provision of rotary guide surfaces, the stripper guides according to the present invention have advantages such that the ends of the rolled material which are bend upward or downward during rolling, which would otherwise cause serious jamming accident, are bent back toward the normal pass line so that it is straighter than it would be if no stripper rolls were provided, and flaws in the rolled material are thereby reduced.

What is claimed is:

1. In combination a rolling mill for rolling hot slab into plate or strip and having opposed horizontal upper and lower work rolls and work roll chocks in which said work rolls are mounted, stripper guides being disposed adjacent to the work rolls on the exit side of said rolls and each having a single stripper guide roll rotatably mounted therein, the respective stripper guide rolls being disposed above and below the pass line between the opposed work rolls and spaced from each other a distance equal to the work roll gap plus 5 to 20 mm for bending the turned up or turned down end of a work being rolled back more in line with the length of the plate or strip, a portion of the periphery of each stripper guide roll projecting slightly from the guide surface of the respective stripper guide, each stripper guide roll being the same length as the corresponding work roll, the lower stripper guide being fixed to the lower work roll chocks and the upper stripper guide being fixed to the upper work roll chocks so that the vertical positions of the stripper guide rolls are adjusted relative to each other in accordance with the adjustment of the gap between the work rolls.

2. Stripper guides as claimed in claim 1, further having boxes at opposite ends of said stripper guides and bearings for said rolls being positioned in said boxes, said bearings being split bearings.

3. Stripper guides as claimed in claim 2, in which said bearings are vertically adjustably mounted in said boxes.

* * * * *